US012582218B2

(12) United States Patent
Graff

(10) Patent No.: US 12,582,218 B2
(45) **Date of Patent: *Mar. 24, 2026**

(54) CONFIGURABLE MULTIPURPOSE HAMMOCK

(71) Applicant: Multimok, LLC, Spanish Fork, UT (US)

(72) Inventor: Jacob Christen Graff, American Fork, UT (US)

(73) Assignee: MULTIMOK, LLC, Spanish Fork, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/340,823

(22) Filed: Jun. 7, 2021

(65) Prior Publication Data

US 2021/0289925 A1 Sep. 23, 2021

Related U.S. Application Data

(63) Continuation of application No. 15/694,783, filed on Sep. 2, 2017, now Pat. No. 11,026,499.

(60) Provisional application No. 62/382,927, filed on Sep. 2, 2016.

(51) Int. Cl.

| | |
|---|---|
| ***A45F 3/22*** | (2006.01) |
| ***A45F 3/00*** | (2006.01) |
| ***A45F 3/52*** | (2006.01) |
| ***A45F 4/08*** | (2006.01) |

(52) U.S. Cl.

CPC ..... *A45F 3/22* (2013.01); *A45F 3/52* (2013.01); *A45F 4/08* (2013.01); *A45F 2003/001* (2013.01)

(58) Field of Classification Search

CPC ..... A45F 3/22; A45F 3/52; A45F 3/24; A45F 4/08; A45F 2003/001; A61G 1/01

See application file for complete search history.

(56) References Cited

U.S. PATENT DOCUMENTS 879,335 A * 2/1908 Southmayd ..... A61G 1/013 5/187
955,281 A * 4/1910 Norwood ..... A45F 3/22 5/121
2,378,202 A * 6/1945 Dillon ..... A45F 3/22 139/383 R
4,320,542 A * 3/1982 Cohen ..... E04H 15/04 5/128
5,170,521 A * 12/1992 Light ..... A47C 17/84 5/118

(Continued)

FOREIGN PATENT DOCUMENTS

GB 2401055 A * 11/2004 ..... A45F 4/00

*Primary Examiner* — Matthew Troutman
*Assistant Examiner* — Alison N Labarge
(74) *Attorney, Agent, or Firm* — Goodhue, Coleman & Owens, P.C.

(57) ABSTRACT

A system, method, and multipurpose hammock including a base of interconnected webbing forming a support structure. Each corner of the base includes on a of a number of loops fixing the base to stationary objects when the multipurpose hammock is positioned. The multipurpose hammock further includes a hammock body attachable to the base. The hammock body includes or more connectors proximate a longitudinal edge of the hammock body. The one or more connectors secure at least the longitudinal edge of the hammock body to the base when connected together.

19 Claims, 6 Drawing Sheets

(56) References Cited

U.S. PATENT DOCUMENTS

| | | | | |
|---|---|---|---|---|
| 5,857,231 | A | 1/1999 | Wade | |
| 6,353,946 | B1 * | 3/2002 | Steiner | E04H 15/04 5/120 |
| 6,851,145 | B2 | 2/2005 | Smith et al. | |
| 8,065,765 | B2 | 11/2011 | Rincon | |
| 8,161,991 | B2 * | 4/2012 | Johnson | A45F 3/22 135/96 |
| 8,292,559 | B1 | 10/2012 | Foggy | |
| 9,192,224 | B1 | 11/2015 | Waddy | |
| 9,480,613 | B1 | 11/2016 | Lackey | |
| 9,610,204 | B1 | 4/2017 | Steinbock et al. | |
| 9,854,898 | B2 | 1/2018 | Whitley | |
| 2003/0028962 | A1 * | 2/2003 | Batchelder | A45F 3/22 5/120 |
| 2004/0154098 | A1 * | 8/2004 | Bhatt | A45F 3/22 5/122 |
| 2005/0132495 | A1 | 6/2005 | Girard et al. | |
| 2011/0271450 | A1 | 11/2011 | Johnson et al. | |
| 2014/0345049 | A1 | 11/2014 | Gash | |
| 2016/0213131 | A1 * | 7/2016 | Frazer | A45F 3/52 |
| 2016/0242539 | A1 * | 8/2016 | Paya | A45F 3/22 |
| 2016/0338476 | A1 | 11/2016 | Haug | |
| 2017/0095042 | A1 | 4/2017 | Ressler | |
| 2017/0224092 | A1 | 8/2017 | Smith, Jr. | |

* cited by examiner

CONFIGURABLE MULTIPURPOSE HAMMOCK

PRIORITY

This application is a continuation of U.S. Non-Provisional patent application Ser. No. 15/694,783 filed Sep. 2, 2017 which claims priority to U.S. Provisional Patent Application 62/382,927 filed Sep. 2, 2016 and entitled Configurable Multipurpose Hammock, hereby incorporated by reference in its entirety.

BACKGROUND

Hammocks are support mechanisms suspended from rope or cords at endpoints. Hammocks have traditionally been made of canvas or rope mesh. Hammocks are often used for sleeping, lounging, resting, or for other camping and recreational activities. The design and shape of hammocks have not changed significantly within the last century despite improvements in manufacturing processes, material science, and other applicable information.

SUMMARY

One embodiment provides a system, method, and multipurpose hammock including a base of interconnected webbing forming a support structure. Each corner of the base includes on a of a number of loops fixing the base to stationary objects when the multipurpose hammock is positioned. The multipurpose hammock further includes a hammock body attachable to the base. The hammock body includes or more connectors proximate a longitudinal edge of the hammock body. The one or more connectors secure at least the longitudinal edge of the hammock body to the base when connected together.

Another embodiment provides a multipurpose hammock including a base of interconnected webbing forming a support structure. Each corner of the base includes on a of a number of loops fixing the base to stationary objects when the multipurpose hammock is positioned. The multipurpose hammock further includes a hammock body removably attached to the base. The hammock body includes one or more removable supports for forming a tent structure within the hammock body.

One embodiment provides a system, method, and multipurpose hammock including a base of interconnected webbing forming a support structure. An outer edge of the base includes multiple loops within the webbing. The multipurpose hammock also includes a hammock body attached to the base. The hammock body includes one or connectors proximate a longitudinal edge of the hammock body. The one or more connectors secure at least the longitudinal edges of the hammock body when connected together and one or more liners removable attached to the one or more connectors.

The connectors may represent one or more zippers. In one embodiment, any number of liners may be connected to the connectors. The liners may include a tent structure for covering one or more users in the multipurpose hammock. The plurality of loops may be utilized to configure the multipurpose hammock in any number of configurations.

Another embodiment provides a multipurpose hammock. The multipurpose hammock may include a base of interconnected webbing connected by stitching to form a support structure. An outer edge of the base includes multiple loops. Multiple rings are attached to at least the webbing. The multipurpose hammock may also include a hammock body connected to the base. The hammock body includes one or more connectors proximate a longitudinal edge of the hammock bod. The one or more connectors secure at least the longitudinal edges of the hammock body when connected and one or more liners removably attached to the one or more connectors.

BRIEF DESCRIPTION OF THE DRAWINGS

Illustrative embodiments are described in detail below with reference to the attached drawing figures, which are incorporated by reference herein and wherein.

DETAILED DESCRIPTION OF THE DRAWINGS

The illustrative embodiments provide a multi-use hammock, system, and method. In one embodiment, the multi-use hammock may be utilized to hold, secure, or carry heavy loads. In one embodiment, the hammock may include multiple liners that support significant loads as well as different structures. The multi-use hammock may be configured for any number of needs of a user. For example, the multi-use hammock may be shaped, converted, or configured for a number of uses. In one embodiment, the multi-use hammock may also be referred to as a Multimok®.

In one embodiment, the multipurpose hammock may replace single-functioning outdoor or camping gear, such as a camp chair, sleeping bag, tent, tarp, pop-up cover, gear storage, and a traditional hammock. The multipurpose hammock may be significantly lighter than the gear and equipment it replaces. The multipurpose hammock may be utilized by campers, backyard relaxers, day hikers, military personnel, emergency rescue specialists, first responders, hunters, picnickers, wildland firefighters, outdoor enthusiasts, and other users. The multipurpose hammock may be configured in any number of modes or configurations including, but not limited to: normal, double, mummy/cocoon, monkey bridge, suspended tube tent, bowl, three-point, four-point, wagon wheel, suspended surface/bed, sofa/chair, windbreak/shade roof, bear bag, cargo net/cover, and knapsack/duffle bag to name a few.

Turning now to FIGS. 1-5, showing various views and components of a multi-function hammock 100 in accordance with an illustrative embodiment. The multipurpose hammock 100 may include any number of components, connectors, and layers as are described herein. In one embodiment, the multipurpose hammock 100 may be rectangular shaped.

In other embodiments, the multipurpose hammock may utilize other shapes, such as an ellipse, square, circle, hourglass, rectangular star, parallelogram, triangle, rhombus, or other custom shapes based on the application. The multipurpose hammock 100 may utilize smooth or extended edges and ends. Likewise, the multipurpose hammock 100 may be symmetrically shaped or asymmetrically shaped. In one embodiment, the multipurpose hammock 100 may have edges and ends that taper in or flare out. Any number of shapes are contemplated with regard to the embodiments described herein.

Figure 2:
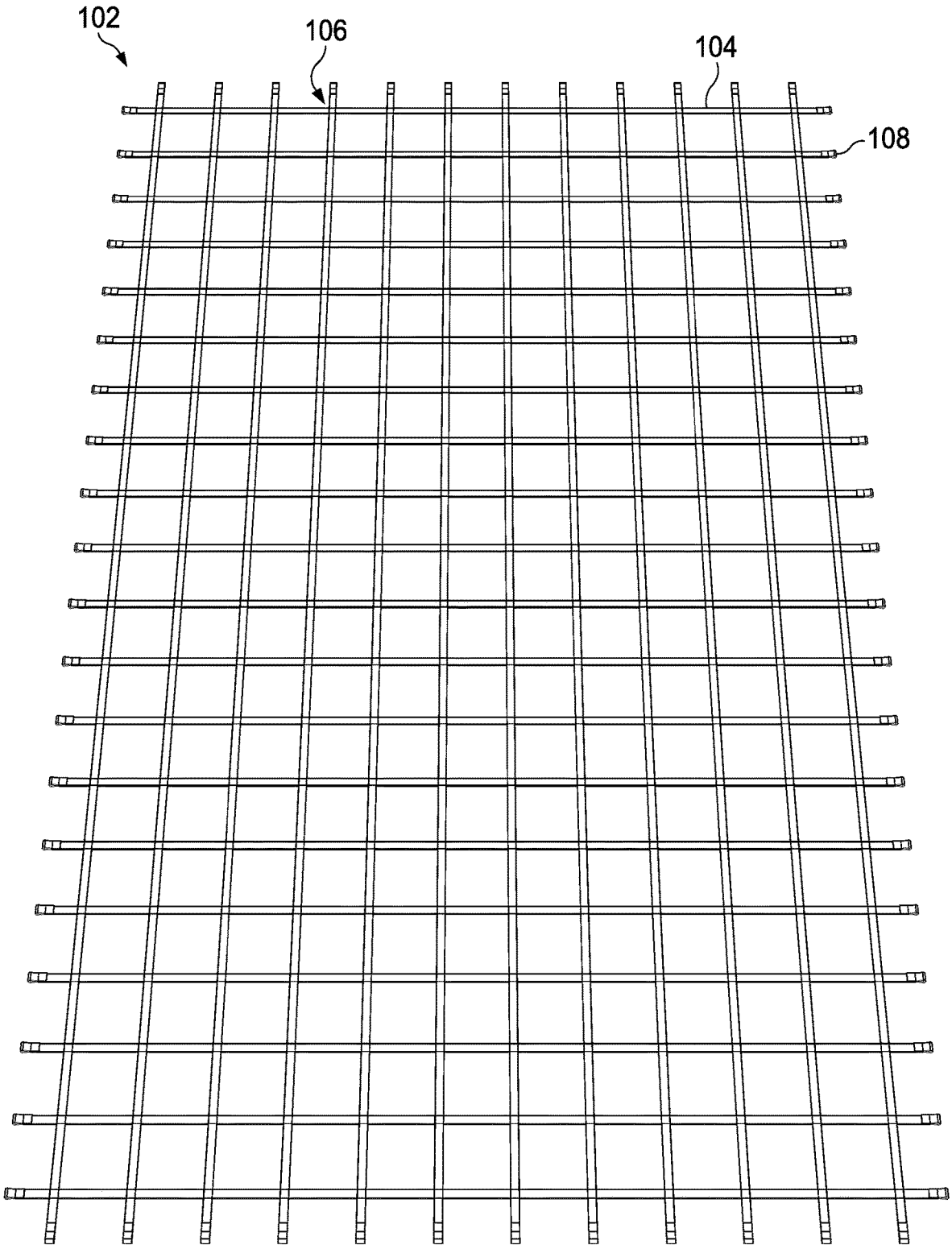
FIG. 2 is a pictorial representation of a base of the multipurpose hammock of FIG. 1 in accordance with an illustrative embodiment.

In one embodiment, the multipurpose hammock 100 includes a base 102 (see FIG. 2). The base 102 is a base, framework, or support layer of the multipurpose hammock 100. The base 102 may be formed entirely or in part by webbing 104. For example, the base 102 may be a framework or network of webbing 104 that are parallel to or crisscross each other to form a series of squares or rectangles. In one embodiment, the base 102 may include a grid of webbing straps that provide a support structure to the multipurpose hammock 100. The space between the webbing 104 may vary based on the application. For example, if the multipurpose hammock 100 is utilized for recreational purposes, the space between the webbing 104 may represent five inches (5"). In another example, commercial utilization of the multipurpose hammock 100 may be utilized to support additional weight, and may require significantly more webbing 104 with smaller spaces between the white webbing (e.g., the open spaces defined between the webbing), such as two inches (2"). The webbing may also be referred to as interconnected straps.

As previously disclosed, the base 102 may be rectangular shaped. However, the base 102 may incorporate any number of other shapes. Similarly, the pattern of the webbing 104 may be a grid pattern as shown or may represent any number of frameworks or patterns, such as diagonal webbing 104 (e.g., diamond shapes), honeycomb webbing 104, triangular webbing 104, asymmetric shapes, or so forth.

The webbing 104 may be formed of any number of materials. In one embodiment, the webbing 104 may be formed of ½" to 1" wide polyester, polypropylene, silk, denim, or nylon straps. In other embodiments, the webbing may be 2" to 6" wide. The webbing 104 may utilize straps of different widths in different embodiments. In one embodiment, the middle portion of the webbing 104 most likely to support the body or imparted weight may be wider (e.g., running lengthwise along the webbing). The periphery of the webbing 104 may also be reinforced as needed. In other embodiments, the thicknesses of the webbing 104 may vary based on the strength and security needed. For example, the outside edges and ends of the webbing 104 may be formed from high tensile strength webbing that is thicker and designed to support more weight. The webbing 104 may also represent cords, straps, cables, wires, or other support mechanisms. The webbing 104 may utilize any number of synthetic or natural fabrics, materials, or supports that have high tensile strength.

The webbing 104 may include straps as shown that facilitate the distribution of weight to remove pressure points on the user or goods positioned within the multipurpose hammock 100. However, the width of the webbing 104 may vary based on the support needs of the multipurpose hammock 100. Similarly, the webbing 104 may be formed of any number of materials, fabrics. The webbing 104 may also include any number or combination of materials or embedded support structures, such as wires, cables, Kevlar, carbon fiber, fiberglass, Synteen, weaved patterns, composites, and so forth. The additional support structures may be manufactured, integrated with, or attached to the webbing 104. The webbing 104 as well as the other materials of the multipurpose hammock 100 may be laminated or coated with any number of synthetic (e.g., vinyl, polyvinyl chloride, woven fiberglass coated with polytetrafluoroethylene, etc.) or natural materials to increase the strength, durability, and environmental resistance of the multipurpose hammock 100. The webbing 10 may also be treated to deter insects (e.g., deet), rodents, bacteria/fungus, or so forth.

In some embodiments, the multipurpose hammock 100 may include reinforcing webbing (not shown) for portions of the base 102 that may be required to support additional weight or may endure additional wear and tear. In one embodiment, the webbing 104 of the base 102 may be interleaved to provide additional support. For example, where the base 102 includes parallel and perpendicular sections of webbing 104 (e.g., along an x and y axis), the parallel sections may alternate going under and over the perpendicular sections. In some embodiments, different portions of the webbing 104 may have different widths, materials, or so forth for the specific needs of the user.

In one embodiment, intersections 106 of the webbing 104 are stitched together to reinforce the webbing 104. For example, high tensile strength nylon or polyester thread may be utilized to create a grid of webbing 104. The webbing 104 may also be attached utilizing adhesives, heat integration (e.g., heated until multiple straps or structures become one), riveted, or otherwise attached. In another embodiment, the webbing 104 may be manufactured in a joint grid or structure for enhanced strength. The intersections 106 represent connection points for the webbing 104 regardless of the pattern or structure utilized for the base 102. In some embodiments, arches, triangles, or other patterns or patches may be utilized for different intersection points of the webbing 104.

Figure 3:
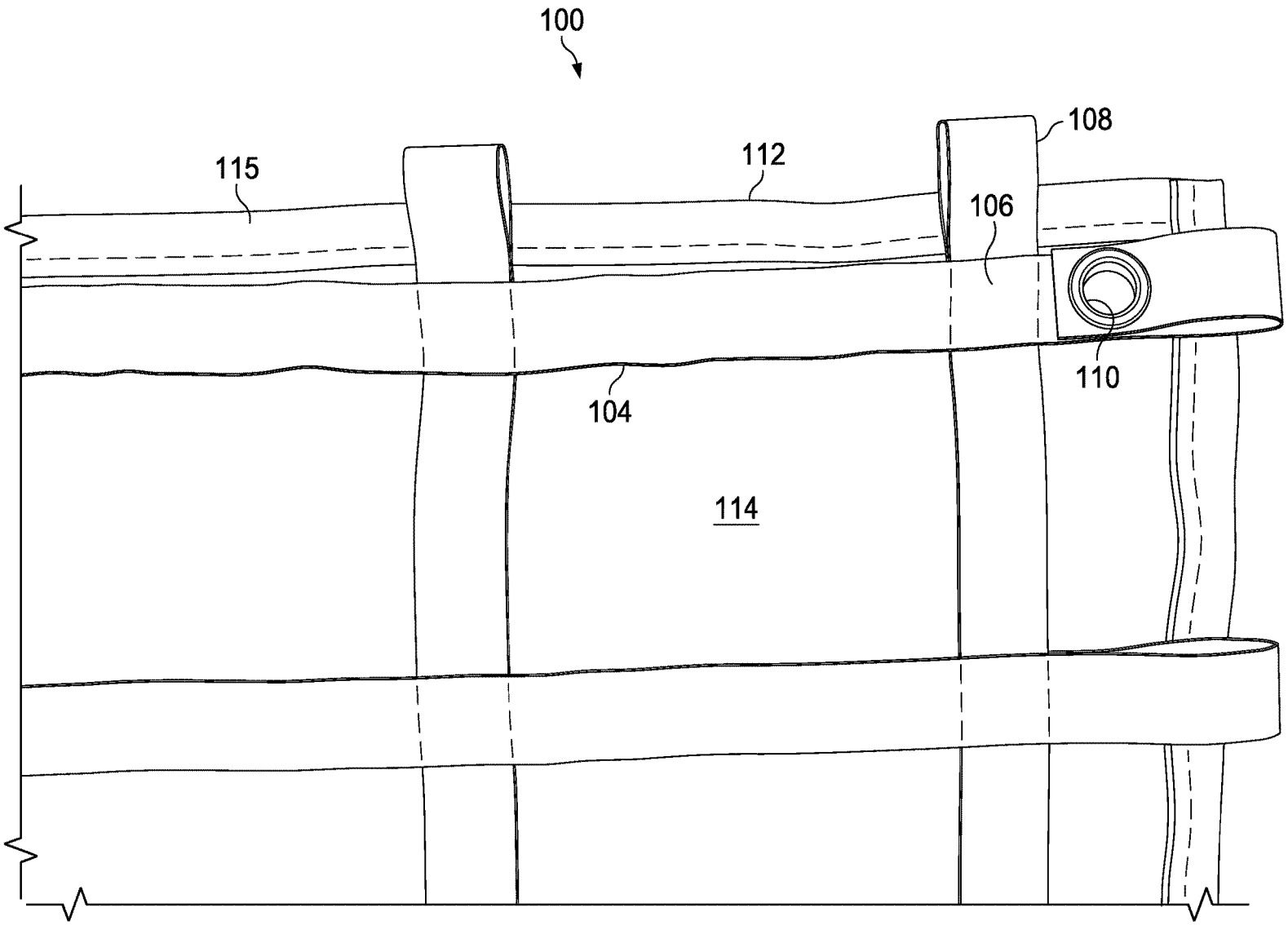
FIG. 3 is a pictorial representation of a corner of the multipurpose hammock of FIG. 1 in accordance with an illustrative embodiment.
Figure 4:
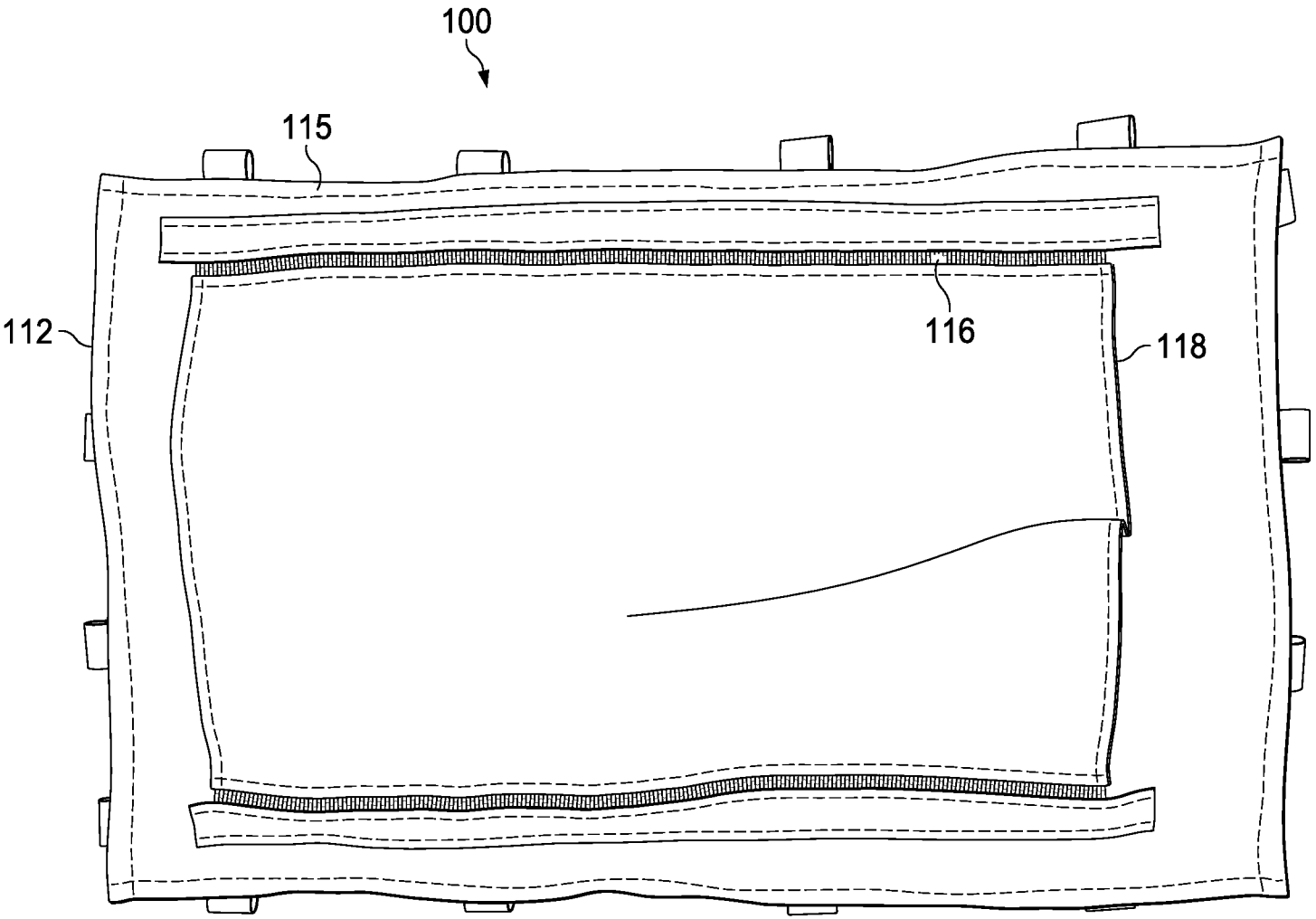
FIG. 4 is a top-view of the multipurpose hammock of FIG. 1 in accordance with an illustrative embodiment.

In one embodiment, the webbing 104 may define loops 108 around the periphery of the webbing 104. The loops 108 are more clearly seen in FIG. 3 showing a corner of the multipurpose hammock 100. The corners of the multipurpose hammock 100 may be reinforced utilizing multiple stacked layers, additional stitching, laminations, or other reinforcements. In one embodiment, the loops 108 may represent a portion of the webbing 104 that is looped back on itself to form the loops 108. The loops 108 may also be attached to or connected with the webbing 104 utilizing other processes as noted. The loops 108 may be produced through stitching, adhesives, an original manufacturing process, rivets, grommets, thermal bonding, or so forth. The loops 108 of the multipurpose hammock 100 may be utilized to secure the multipurpose hammock 100 to any number of support structures or components (e.g., trees, vehicles, posts, buildings, etc.). For example, hooks, ropes, straps, carabiners, bands, or other securing components may be attached to the loops 108. The loops 108 of the multipurpose hammock 100 may also be utilized to form any number of structures or configurations needed by one or more users. For example, the different loops 108 may be interconnected, used as pass throughs, tightened, secured, or so forth.

In other embodiments, the loops 108 may represent any number of connection mechanisms that may be integrated with the webbing 104, such as hooks, carabiners straps, ropes, or so forth. In one embodiment, the loops 108 are integrated with the base 102 and the webbing 104 to specially configure the multipurpose hammock 100. In another embodiments, the loops 108 may extend from other portions of the webbing 104, such as in the middle of the grid of webbing 104 that in part makes up the base 102. In one embodiment, the loops 108 may be one to two inches in length (1-2"), however, loops of any size may be utilized based on the application.

In one embodiment, the base 102 including the webbing 104, intersections, or loops 108 may include any number of rings 110. The rings 110 may be formed from metal or other high strength materials to support the weight of the user or goods stored within the multipurpose hammock 100. In one embodiment, the webbing 104 is threaded through the rings 110 to create access or securing points. The rings 110 may be also be attached or integrated with reinforced corners of the multipurpose hammock 100. In one embodiment, the rings may be positioned at corners of the multipurpose hammock 100. The rings 110 may also be positioned along the exterior edges of the base 102 or on the loops 108. In other embodiments, the rings 110 may be placed anywhere along the webbing 104 (or hammock body 112). The size and shape of the rings may vary (e.g., 1-4 inches, circular, triangular, oblong, etc.)

In one example, rings 110 in the middle of the multipurpose hammock 100 may allow couplers, connections, or fasteners to further stabilize the multipurpose hammock during utilization. The rings 110 (reinforced eyelets) may also define a whole or opening to act as a drain allowing accumulated fluids or liquids to drain from the multipurpose hammock 100. This may be particularly useful if the multipurpose hammock 100 is left in an open position (e.g., no cover) when there is rain or snow accumulation such that the water may drain out and off of the multipurpose hammock 100. Similar to the loops 108, the rings 110 may be utilized to further customize utilization of the multipurpose hammock 100. In one embodiment, the rings 110 may be stamped, adhered, or stitched to the base 102, webbing, 104, loops 108, or other portions of the multipurpose hammock 100. In some embodiments, the base 102, webbing 104, loops 108, and rings 110 of the multipurpose hammock 100 are uniquely configured to support weights of 1000-5000 pounds or more due to the structural integrity of the base 102, webbing 104, and so forth.

A hammock body 112 may be integrated with or attached to the base 102. As previously disclosed, an exterior surface 114 of the hammock body 112 may be attached to the base 102 utilizing any number methods and processes. The hammock body 112 provides additional support to the structure of the multipurpose hammock 100 particularly between the openings defined by the base 102 and webbing 104. In one embodiment, an outside edge 115 of the hammock body 112 may be hemmed, stitched, reinforced, thermally bonded, or sealed (e.g., adhesives, bonding agents, etc.) to prevent or reduce fraying, ripping, or failure of the hammock body 112 during its lifetime. In some embodiments, the hammock body 112 may also be referred to a liner that may be replaceable or interchangeable. The hammock body 112, liners, structures, or other materials may be layered, tiered, nested, or so forth.

In one embodiment, the hammock body 112 may be attached to the base 102 utilizing straps and buckles extending from the hammock body 112, the base 102, or both. The straps, buckles, and other connectors may take any configuration as are known in the art. The straps and buckles may be integrated with an interior or exterior surface of the hammock body 112 as well as the periphery (e.g., ends and edges of the hammock body 112).

In one example, the hammock body 112 is stitched to the base 102 utilizing reinforced nylon or polyester thread and common sewing practices. Adhesives, thermal bonding, fabric rivets or grommets, or any number of other connection or integration components may also be utilized. The hammock body 112 may be composed of any number of fabrics or materials, such as nylon, silk, nylon ripstop, acrylic, nylon mesh, cotton, Rayon, polyester, Gore-Tex, Cordura, Kevlar, Spectra, Dyneema, Zylon, or other natural or synthetic materials or fabrics. The hammock body 112 may be treated with any number of coatings, laminates, baths, or so forth for water proofing, stain resistance, fire resistance, water resistance, insect repellant, UV/sun protection, sealing, and so forth. As previously disclosed, the rings 110 or the loops 108 may also be integrated with the hammock body 112.

In one embodiment, a zipper 116 may be attached to an interior surface 118 of the hammock body 112 along a longitudinal edge or axis. In one embodiment, the zipper 116 may represent one or more pairs of zippers that allow opposite sides of the multipurpose hammock 100 to be zipped together along the length of the hammock body 112 (see FIG. 5). The multipurpose hammock 100 may be zipped together to create an enclosure or compartment that may help provide shelter and warmth to the user whether resting, sleeping, or seeking shelter from the elements (e.g., weather, bugs, light, noise, etc.). A portion of the hammock body 112 may extend on an outside edge of the zipper 116 to shield the user from light, weather, noise, bugs, or other environmental factors.

The zipper 116 (or pairs of zippers) may also be utilized to attach a liner 118. The liner 118 may represent any number of layers or materials, such as cover, strengthening layer, waterproof layer, weather barrier, cushion layer, decorative layer, insulation layer, or so forth. In one embodiment, the liner 118 may represent a sleeping bag or mattress pad that may connect to the zipper 116. In one embodiment, the zipper 116 may represent a double zipper for both connecting a liner 118 as well as closing the hammock body 112 lengthwise. In addition, the zipper 116 may represent any number of integrated or separate zippers (e.g., triple zipper, quadruple zipper, etc.). The liner 118 may also represent one or more layers of materials that may be extended, stretched, or secured (e.g., utilizing integrated or attached loops, straps, rings, connectors, etc.) to form a tent or shelter above the base 102.

Although not shown, the hammock body 112 may further include one or more zippers for securing the multipurpose hammock 100 to itself along the width of the hammock 112. In other embodiments, the hammock body 112 may include buttons, snaps, Velcro, hooks, straps, openings/holes, or other attachment mechanisms. Additional, layers of zippers may be attached to the hammock body 112 for attaching additional liners or other components (e.g., rain fly, canopy, bug shield, etc.). The zipper 116 may operate in a single direction or both directions (e.g., open ended zippers, etc.).

The liner 118 may represent any number of single layer or multi-layer fabrics, materials or structures. In one embodiment, the liner 118 may represent a single layer of natural or synthetic materials, such as nylon, cotton, plastic, Tyvek, Gore-Tex, Cordura, leather, etc. The liner 118 may also represent a blanket similar to a sleeping bag, foam padding, electronic warming/cooling blankets, or so forth. The liner 118 is removable and replaceable and may be utilized at the complete discretion of a user utilizing the multipurpose hammock 100. In one embodiment, the liner 118 may represent a decorative layer or signaling layer that may be viewed from overhead. A large portion of the wear and tear imposed upon the multipurpose hammock may be first applied to the liner 118. As a result, the liner 118 may be utilized until spent and then replaced without replacing the more expensive materials of the base 102 and hammock body 112. For example, the liner 118 may also be utilized to support a portion of a load born by the multipurpose hammock 100. Similarly, the liner 118 may protect portions of the multipurpose hammock 100 from sun, moisture, weather, insects, animals, mold/bacteria/fungus, or other potential damage. The zipper 116 may be configured to connect to multiple liners simultaneously. In one embodiment, a first liner may attach to a second liner (e.g., zippers, buttons, snaps, Velcro, etc.) and the combined liner may connect to the zipper 116 utilizing a zipper associated with the liner 118. The liner 118 may be jointly or independently manufactured and sold as part of the multipurpose hammock 100.

Any number of connectors 120 or couplers may be utilized to secure the multipurpose hammock 100 for utilization. The connectors 120 may represent one or more carabiners, hooks, straps, ropes, cords, bungee cords, wires, cables, or so forth. The couplers 120 may be utilized to connect, tie, attach, or integrate with the loops 108 or the rings 110 of the base 102 to create different configurations of the multipurpose hammock 100. The connectors 120 may be secured to fixtures, such as trees, vehicles, rocks, posts, buildings, or so forth at a single height level or at different levels to facilitate the different configurations. Similarly, different levels of tension, slack, and different lengths of connectors may be utilized to configure the multipurpose hammock 100. Any number of ratcheting systems, buckles, winches, cranks, or so forth may be utilized to secure the connectors 120 and to apply needed tension.

For example, 1) gathering the loops 108 on a first end of the multipurpose hammock 100 and connecting those loops 108 to a first coupler and a first attachment point (e.g., a tree) and 2) the loops 108 on a second end of the multipurpose hammock 100 and connecting those loops 108 to a second coupler and a second attachment point may resemble a classic hammock configuration. The user may utilize loops on just the corners to configure the multipurpose hammock 100 as a tube hammock. In another example, loops 108 at opposing corners of the multipurpose hammock 100 may be secured at eye level and loops 108 at the other opposing corners may be secured at a second lower level to create a chair or porch swing (e.g., may require two attachment points, four couplers are required). In another example, four couplers may attach to each corner of the multipurpose hammock 100 with each pulling against each other to create a flat or bed configuration (e.g., may require four attachment points or trees, four couplers are required). In another example, two or more multipurpose hammocks 100 may be connected together in a double configuration (or triple, quadruple, wagon wheel). Other configurations may include monkey bridge, bowl, windbreak/shade roof, bear bag, cargo net and cover, and knapsack/duffle bag.

The multipurpose hammock 100 may come in any number of sizes or shapes, such as 98"×57" for a large size and 110"×69" for an extra-large size. Smaller sizes (or shapes) may also be utilized for smaller individuals, such as children, pets, or smaller adults. Larger sizes and shapes may also be utilized for multiple users and different configurations. The multipurpose hammock 100 may include any number of accessories, such as a rainfly, mosquito net, locking carabiners, quick clip carabiners, heavy duty and regular straps (with or without loops), liners (e.g., 0 degree quilted, 30 degree quilted, waterproof liner/water storage, cotton, denim, leather, padded, etc.), pillow, air mattress and so forth.

In another embodiment, the multipurpose hammock 100 may include a pulley system/connectors for lifting the multipurpose hammock 100 of the ground or higher into the air. For example, a double or triple pulley system may allow the user to rig the multipurpose hammock 100, such that the user may lift herself into the air for security or protection. The multipurpose hammock 100 may also come with one or more attachment posts for securing one or more ends of the multipurpose hammock 100 (including loops 108 and rings 110) to the connectors 120.

Figure 6:
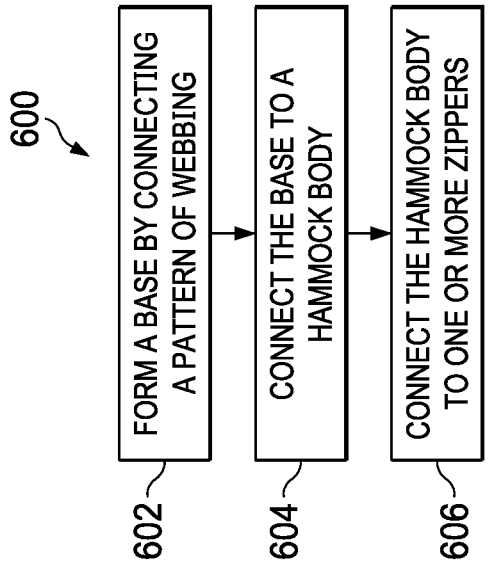
FIG. 6 is a flowchart of a process for manufacturing a multipurpose hammock in accordance with an illustrative embodiment.
Figure 5:
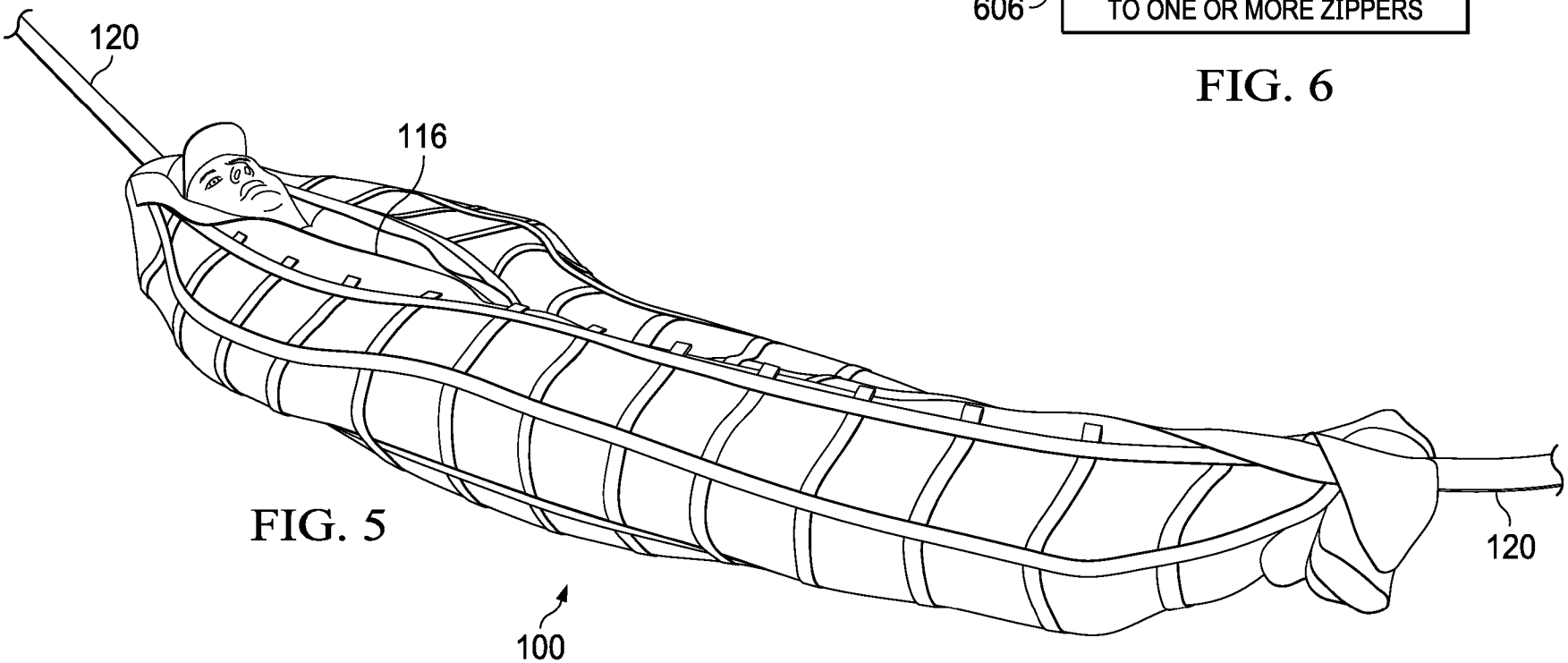
FIG. 5 is a pictorial representation of a multipurpose hammock being used in a partially closed configuration in accordance with an illustrative embodiment.

FIG. 6 is a flowchart of a process for manufacturing a multipurpose hammock in accordance with an illustrative embodiment. The process of FIG. 6 may be performed automatically utilizing any number of robotic systems and commercial sewing machines or based on interaction with a user. Any number of processes may be utilized to manufacture the multipurpose hammock 100. In one embodiment, a base may be formed by connecting a pattern of webbing (step 602). During step 602, intersection points for the webbing may be connected, attached or integrated utilizing stitching, adhesives, thermal bonding, or so forth. The webbing may also be formed into loops around the periphery of the base (including the edges/longitudinal axis and ends/width). For example, straps that make up the webbing may be stitched to form loops. The pattern may represent a grid (e.g., crisscrossed square or rectangular webbing straps, diagonal straps, triangular pattern, etc.). In another embodiment, the webbing may be manufactured as a single pattern.

Next, the system connects the base to a hammock body (step 604). In one embodiment, the hammock body may have already been hemmed, sealed, laminated, soaked, or otherwise treated for longevity. The base may also be connected to or attached to the hammock body utilizing stitching, adhesives, thermal bonding, or so forth.

Next, the system connects the hammock body to one or more zippers (step 606). One or more zippers may be attached to the various edges of the hammock body and/or webbing. The zippers may be attached along the length or width portions of the hammock body proximate the edges. In one embodiment, a number of zippers may be secured proximate each edge. For example, the zippers may be utilized to zip opposing sides of the multi-use hammock together to form a mummy, cocoon, or tube tent configuration. Other zippers may be utilized to connect one or more liners to the multi-use hammock. The zippers of step 606 may also be referenced as connectors. The connectors may also be straps/buckles, loops, buttons, Velcro, clamps, or other fasteners.

Liners, hammock body's, layers, structures, or materials may be added or removed from the multipurpose hammock at any time to meet a user desired purpose or configuration (e.g., aesthetics, functional, etc.). In addition, the liners may be used until worn out to preserve the lifespan of the other portions of the multipurpose hammock.

In another embodiment, one or more rings may be attached to the webbing and/or hammock body. The rings may provide an additional attachment point for securing or configuring the multipurpose hammock. All or portions of the multipurpose hammock (e.g., edges, corners, adjacent loops, around the base, etc.) may also be strengthened with additional layers of material/fabric, additional stitching, or so forth to further strengthen the multipurpose hammock. Any number of coatings, treatments, or sealants may also be applied to all or portions of the multipurpose hammock to achieve a desired effect (e.g., water proofing, UV protection, wind resistance, bug repellent, fire retardant, etc.).

The illustrative embodiments may also provide a process for utilizing a multipurpose hammock in accordance with an illustrative embodiment. The process described may be performed utilizing a multipurpose hammock as described herein. A user may select a configuration of the multipurpose hammock and have instructions (e.g., written, audio, video, etc.) and materials (e.g., couplers, carabiners, attachment points/devices, etc.) available to properly secure and configure the multipurpose hammock.

In one embodiment, the process may begin by securing couplers to at least two loops at ends of a multipurpose hammock to attachment points/structures in order to support the necessary weight. The couplers may include straps, ropes, wires, cables, carabiners, clips, hooks, fasteners, or other attachment components. The attachment points/structures may correspond to one or more portions of a tree, post, vehicle, facility, rock, or so forth. The number and position of loops or rings utilized or interconnected, number of attachment points, height of the attachment points, lengths and tightness of the couplers, attached liners or accessories, and any number of other conditions, parameters, or factors may be utilized to select the configuration of the multipurpose hammock. In one embodiment, the zippers are not utilized to support the weight held by the multipurpose hammock.

The user may be warned to cease use or repair the multipurpose hammock if fraying, ripping, or other damage is viewed, heard, felt, or otherwise detected. Similarly, all or portions of the multipurpose hammock (e.g., liners, loops/straps, couplers, connectors, etc.) may be replaced, repaired, or modified if worn or damaged.

Figure 1:
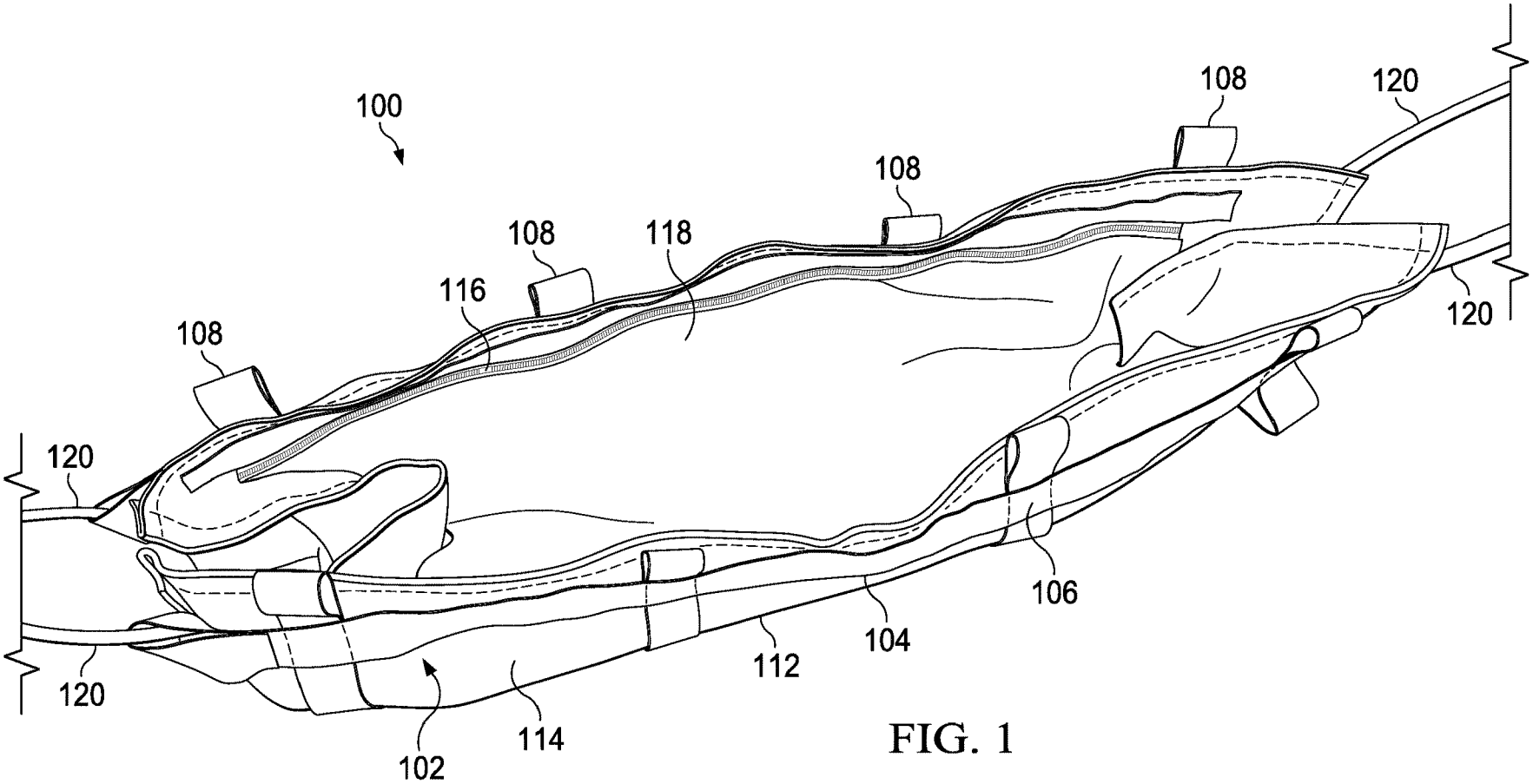
FIG. 1 is a pictorial representation of a multipurpose hammock in accordance with an illustrative embodiment.
Figure 7:
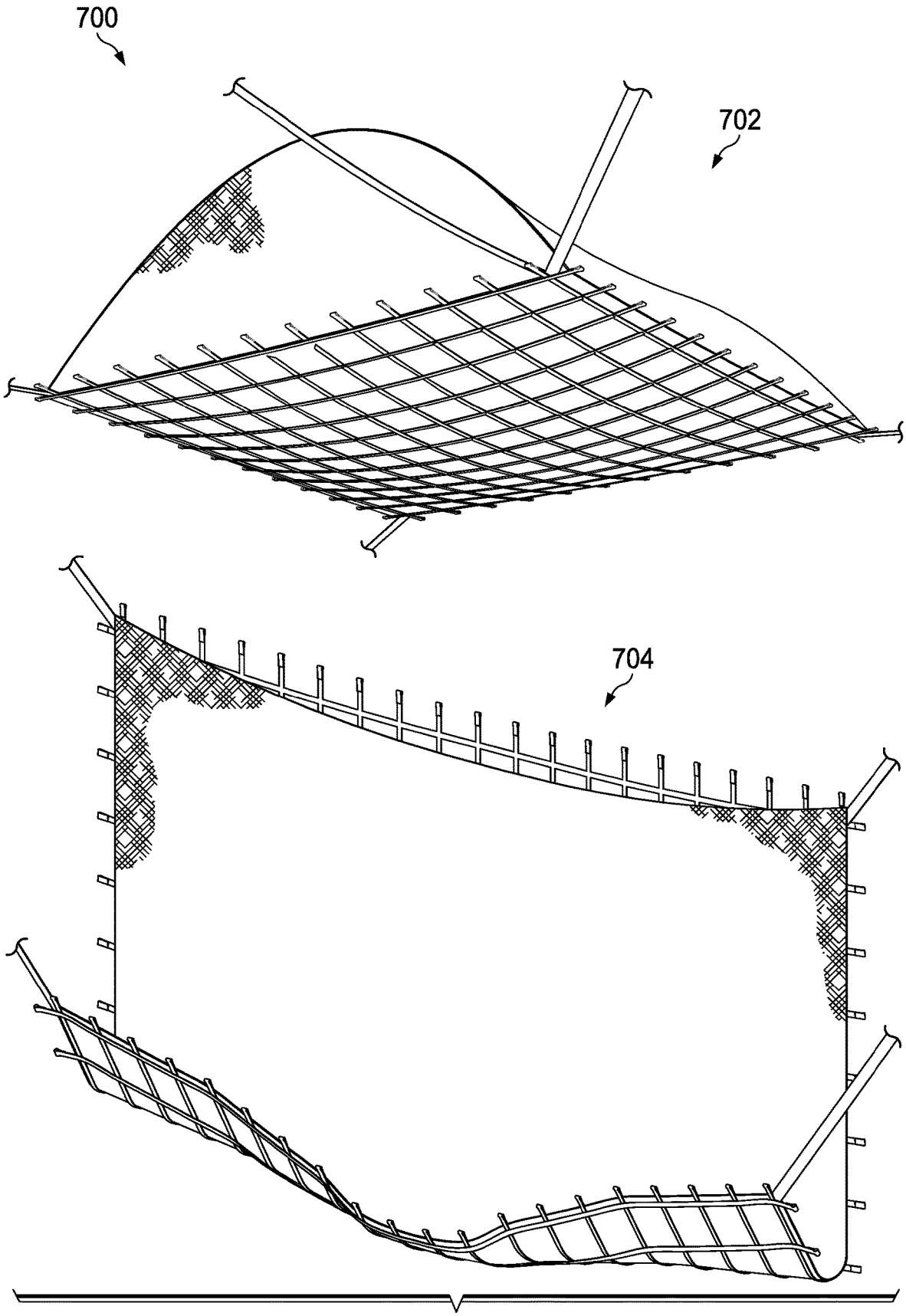
FIG. 7 illustrates pictorial representations of different configurations of the multipurpose hammock of FIG. 1 in accordance with illustrative embodiments.

FIG. 7 illustrates pictorial representations of different configurations 700 of the multipurpose hammock of FIG. 1 in accordance with illustrative embodiments. Common configurations of the multipurpose hammock may include:

Two-point mummy in which all or some of the loops along the edges of the multipurpose hammock are gathered or attached together to create a standard hammock configuration. The two ends are secured between securing points (e.g., trees, structures, etc.). The two-point mummy configuration may tightly secure the user along the length of the body of the user.

Three point or triangle configuration in which one end of the multipurpose hammock is gathered together along one or more loops to create a single point (e.g., the point of the triangle, closed end, gathered end, etc.). The single point at the end of the multipurpose hammock is connected to a tree or structure. The edge of the opposing ends are secured at two or more points along the open end to create the supporting or base points of the three point configuration. In one embodiment, the user's head is positioned at the open end where the multipurpose is extended and the user's feet are positioned at the tip or closed end of the three-point configuration.

Three-point three configuration: This configuration is the same as the three-point configuration, except a number of multipurpose hammocks are connected together and the open ends to each other. The tips or closed ends of the multipurpose hammocks are secured to available supports. In other embodiments, even more multipurpose hammocks may be secured together to create a spoke or wagon wheel type configuration. In another version, two multipurpose hammocks in the three-point configuration may be secured adjacent to each other and pointed in different directions to form a rectangle or square. In one example, four supports may be utilized. The support points that are adjacent to the other multipurpose hammock may share a support point with the other multipurpose hammock.

Four-point configuration 702 in which each of at least four corners is pulled to opposing supports at identical heights to extend the multipurpose hammock taut into a flat or semi flat surface. For example, each support may be pulled at a forty-five-degree angle to an available support. The strength of the base of the multipurpose hammock allows the corners of the multipurpose hammock to be pulled extremely taut. As a result, the multipurpose hammock may provide substantial support to user's or objects positioned on the multipurpose hammock. For example, an air mattress, sleeping pad, blankets, or sleeping bag may be substantially supported as if positioned on a fixed surface, such as the ground, a bed, or platform. In one embodiment, the four-point configuration 702 may be utilized to provide a cover or support. Multiple multipurpose hammocks may be secured above and below each other in a bunk bed configuration. Any number of covers or liners may be utilized with the four-point configuration to add shade, cover, or shed water. For example, an A-frame tent cover may be secured above the four-point configuration 702 as shown in FIG. 7. Any number of strings, ropes, straps, or securing mechanisms may be utilized to create a cover for the user.

Four-point chair configuration 704 in which opposing ends of the multipurpose hammock are secured tightly at different levels and separated by a small distance to create a couch or chair configuration.

The illustrative embodiments are not to be limited to the particular embodiments described herein. In particular, the illustrative embodiments contemplate numerous variations in the type of ways in which embodiments may be applied. The foregoing description has been presented for purposes of illustration and description. It is not intended to be an exhaustive list or limit any of the disclosure to the precise forms disclosed. It is contemplated that other alternatives or exemplary aspects are considered included in the disclosure. The description is merely examples of embodiments, processes or methods of the invention. It is understood that any other modifications, substitutions, and/or additions may be made, which are within the intended spirit and scope of the disclosure. For the foregoing, it can be seen that the disclosure accomplishes at least all of the intended objectives. The drawings include may also not be shown to scale and are shown as illustrative of potential embodiments.

The previous detailed description is of a small number of embodiments for implementing the invention and is not intended to be limiting in scope. The following claims set forth a number of the embodiments of the invention disclosed with greater particularity. The description, FIGS., and embodiments are applicable across each configuration, application, hammock, species, and iteration of the illustrative embodiments regardless of artificial distinctions or restrictions that may be asserted. The embodiments may be configured utilizing any number of components, features, processes, and so forth across the various embodiments.

What is claimed:

1. A multipurpose hammock, comprising:

a base of interconnected webbing forming a support structure, wherein the interconnected webbing defines open spaces, wherein the webbing is ½" or greater in width, and wherein each corner of the base of interconnected webbing defines one of a plurality of loops fixing the base to stationary objects when the multipurpose hammock is positioned; and a hammock body attachable to and supported directly on the base of interconnected webbing configured to support weight of a user of the multipurpose hammock on the base and hammock body, wherein the hammock body includes one or more connectors proximate a longitudinal edge of the hammock body and at each corner of the base, and wherein the one or more connectors secure at least the longitudinal edges and corners of the hammock body to the base when connected together.

2. The multipurpose hammock of claim 1, wherein each of the plurality of loops are connected to the stationary objects utilizing a strap.

3. The multipurpose hammock of claim 1, wherein the hammock body provides an internal space for one or more users.

4. The multipurpose hammock of claim 3, wherein the hammock body is supported by one or more removable supports to form a shape with the internal space for the one or more users.

5. The multipurpose hammock of claim 1, wherein an outer edge of the base defines a plurality of exterior loops within the webbing.

6. The multipurpose hammock of claim 1, wherein the webbing crisscrosses to form the support structure, and wherein the webbing is stitched together at intersections where the webbing crisscrosses.

7. The multipurpose hammock of claim 1, wherein one of a plurality of rings is connected to each of the plurality of loops.

8. The multipurpose hammock of claim 1, wherein the hammock body includes a plurality of layers that are attached together.

9. The multipurpose hammock of claim 8, wherein the plurality of layers include any of a padding layer defining a bottom that sits on the base, a bug net, and a rain cover.

10. A multipurpose hammock, comprising:

a base of interconnected webbing connected by stitching to form a support structure configured to support weight of a user of the multipurpose hammock, wherein the webbing is ½" or greater in width, and wherein each corner of the base of interconnected webbing defines one of a plurality of loops fixing the base to stationary objects when the multipurpose hammock is positioned; and a hammock body removably attached to the base, wherein a bottom portion of the hammock body is supported directly on the base of interconnected webbing, wherein the hammock body includes one or more removable supports for forming a tent structure within the hammock body, wherein the interconnected webbing defines open spaces, wherein the hammock body is formed from ripstop nylon, and wherein the webbing is formed from nylon straps.

11. The multipurpose hammock of claim 10, wherein a plurality of liners are attachable to the hammock body.

12. The multipurpose hammock of claim 10, wherein the bottom portion is a padded bottom support.

13. The multipurpose hammock of claim 10, wherein the hammock body includes one or more securing mechanisms for supporting the hammock body in the tent structure utilizing a string or rope.

14. The multipurpose hammock of claim 10, wherein the webbing crisscrosses to form the support structure, wherein the webbing is stitched together at intersections where the webbing crisscrosses.

15. The multipurpose hammock of claim 10, wherein a periphery of the base includes a plurality of exterior loops within the webbing.

16. The multipurpose hammock of claim 10, wherein the plurality of loops at the corners each includes a ring.

17. The multipurpose hammock according to claim 10, wherein the hammock body includes one or more zipper openings for entering and exiting the tent structure.

18. The multipurpose hammock of claim 10, wherein the hammock body includes one or more side connectors proximate a longitudinal edge of the hammock body, the one or more side connectors secure at least the longitudinal edge of the hammock body to the base and connectors at the corners when connected together, wherein the webbing crisscrosses in a grid to form the support structure, and wherein the webbing is interleaved.

19. The multipurpose hammock of claim 10, wherein edges of the hammock body and corners of the hammock body are reinforced with additional stitching and material.

* * * * *